US011369184B1

(12) United States Patent
Hooper

(10) Patent No.: US 11,369,184 B1
(45) Date of Patent: Jun. 28, 2022

(54) DETACHABLE PAINT BUCKET

(71) Applicant: Travis Lee Hooper, Houston, TX (US)

(72) Inventor: Travis Lee Hooper, Houston, TX (US)

( * ) Notice: Subject to any disclaimer, the term of this patent is extended or adjusted under 35 U.S.C. 154(b) by 0 days.

(21) Appl. No.: 17/203,422

(22) Filed: Mar. 16, 2021

(51) Int. Cl.

| | |
|---|---|
| ***A45F 3/14*** | (2006.01) |
| ***A45F 3/00*** | (2006.01) |
| ***B44D 3/14*** | (2006.01) |
| *B44D 3/12* | (2006.01) |

(52) U.S. Cl.
CPC ..... *A45F 3/005* (2013.01); *B44D 3/14* (2013.01); *A45F 2003/003* (2013.01); *A45F 2003/008* (2013.01); *B44D 3/123* (2013.01)

(58) Field of Classification Search
CPC ..... A45F 3/005; A45F 2003/003; A45F 2003/008; B44D 3/14; B44D 3/123
See application file for complete search history.

(56) References Cited

U.S. PATENT DOCUMENTS

| | | | | |
|---|---|---|---|---|
| 4,828,154 | A * | 5/1989 | Clifton, Jr. | A45F 5/14 224/192 |
| 5,489,051 | A * | 2/1996 | Robinson | A45F 5/02 206/361 |
| 6,283,345 | B1 * | 9/2001 | Butschat | A45F 5/02 224/148.4 |
| 6,719,178 | B1 * | 4/2004 | Taylor | A45F 3/02 224/148.7 |
| 9,463,662 | B1 * | 10/2016 | Sotolongo | A45F 5/021 |
| 2017/0055684 | A1 * | 3/2017 | Jackson | B44D 3/128 |
| 2021/0298462 | A1 * | 9/2021 | Joye | B44D 3/24 |

* cited by examiner

*Primary Examiner* — Corey N Skurdal
(74) *Attorney, Agent, or Firm* — Plager Schack LLP; Mark H. Plager; Kara Verryt

(57) ABSTRACT

A detachable latching paint bucket sized to accommodate a volume of liquid may include a container body with a bottom and side walls extending upward from the bottom, defining an interior of the container body; a latching mechanism attached to one of the side walls; and a strap with a connector configured to removably engage with the latching mechanism, such that the container body is designed to swivel with respect to the strap, wherein the strap is configured to removably engage with a user.

8 Claims, 4 Drawing Sheets

DETACHABLE PAINT BUCKET

BACKGROUND

The embodiments herein relate generally to painting accessories, and more particularly, to a weighted paint bucket that removably attaches to a strap using a latching mechanism, wherein the latching mechanism also provides for the bucket being capable of swiveling with respect to the strap during use.

There are over 34,000 ladder accidents a year. Always having to hold a paint can while climbing a ladder is dangerous and can contribute to the ladder accidents and fatalities.

Therefore, what is needed is a device that provides for hands-free carrying of a pain bucket, wherein the device provides for swiveling of the paint bucket, preventing or reducing spillage regardless of the positioning of the user.

SUMMARY

Some embodiments of the present disclosure include a detachable latching paint bucket sized to accommodate a volume of liquid may include a container body with a bottom and side walls extending upward from the bottom, defining an interior of the container body; a latching mechanism attached to one of the side walls; and a strap with a connector configured to removably engage with the latching mechanism, such that the container body is designed to swivel with respect to the strap, wherein the strap is configured to removably engage with a user, thus allowing the user to use the paint bucket hands-free.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
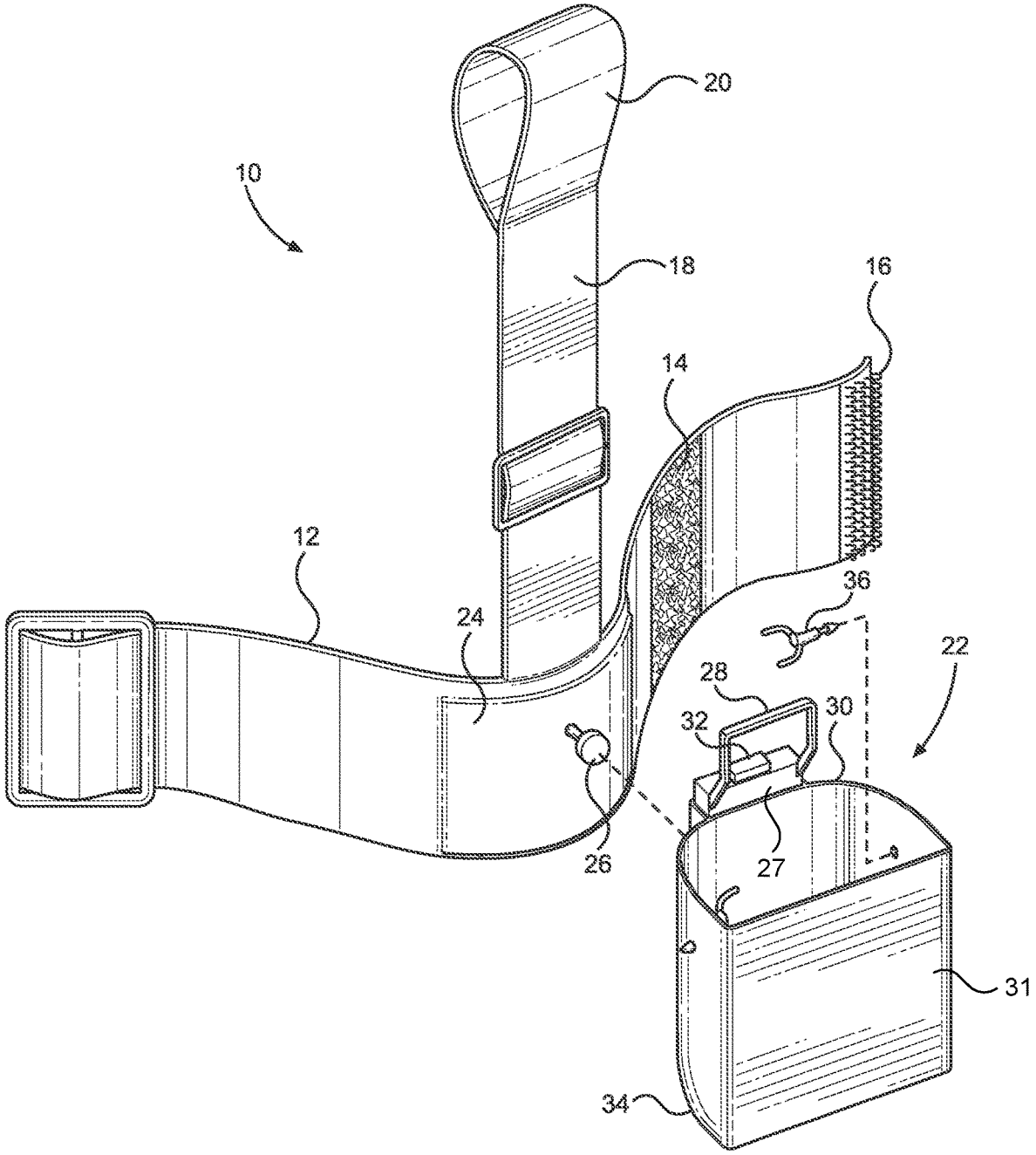
FIG. 1 is an exploded perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a paint bucket and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the device of the present disclosure may be related in the following exemplary fashion. It is not intended to limit the scope or nature of the relationships between the various elements and the following examples are presented as illustrative examples only.

By way of example, and referring to FIGS. 1-4, some embodiments of the present disclosure include a detachable latching paint bucket 10 sized to accommodate a volume of liquid, such as paint, the detachable latching paint bucket 10 comprising a container body 22 with a convex curved bottom 34 and side walls extending upward from the curved bottom 34; a latching mechanism attached to one of the side walls; and a strap with a connector configured to removably engage with the latching mechanism, such that the container body 22 is designed to swivel with respect to the strap to keep the bottom 34 of the container body 22 positioned toward the ground surface.

As shown in the Figures, the paint bucket 10 may comprise a container body 22 with a curved bottom 34, a curved rear wall 30 extending upward from the curved bottom 34, a front wall 31 extending upward from the curved bottom 34, and an open top. In some embodiments, and as shown in the Figures, the front wall 31 may be substantially planar and, thus, not curved. As mentioned above, a latching mechanism may be attached to one of the side walls, wherein the side walls may comprise the rear wall 30 and the front wall 31. In a particular embodiment, the latching mechanism may be attached to the rear wall 30.

Figure 3:
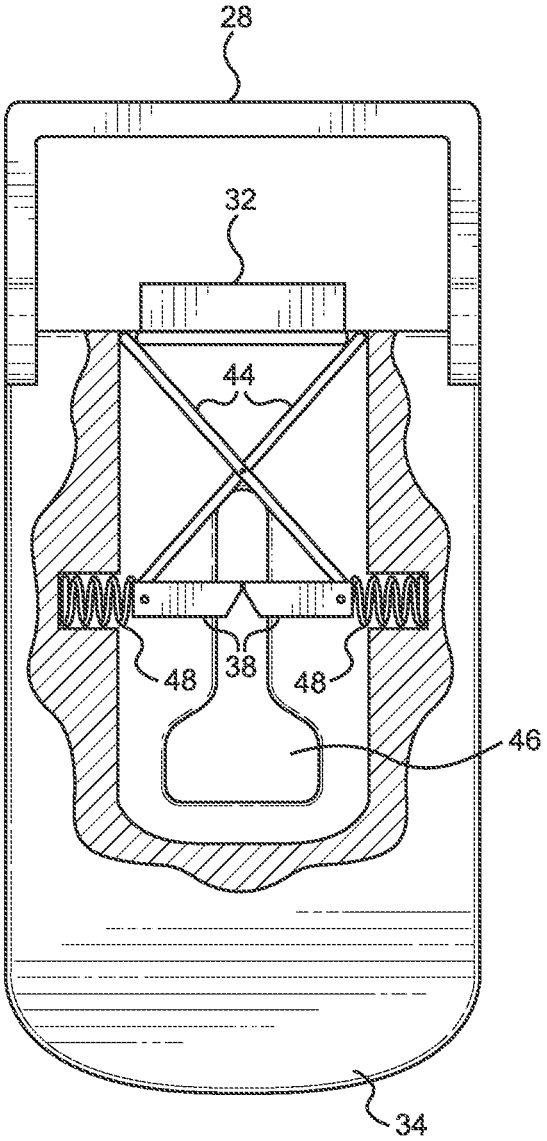
FIG. 3 is a rear cut-away view of one embodiment of the present disclosure.
Figure 4:
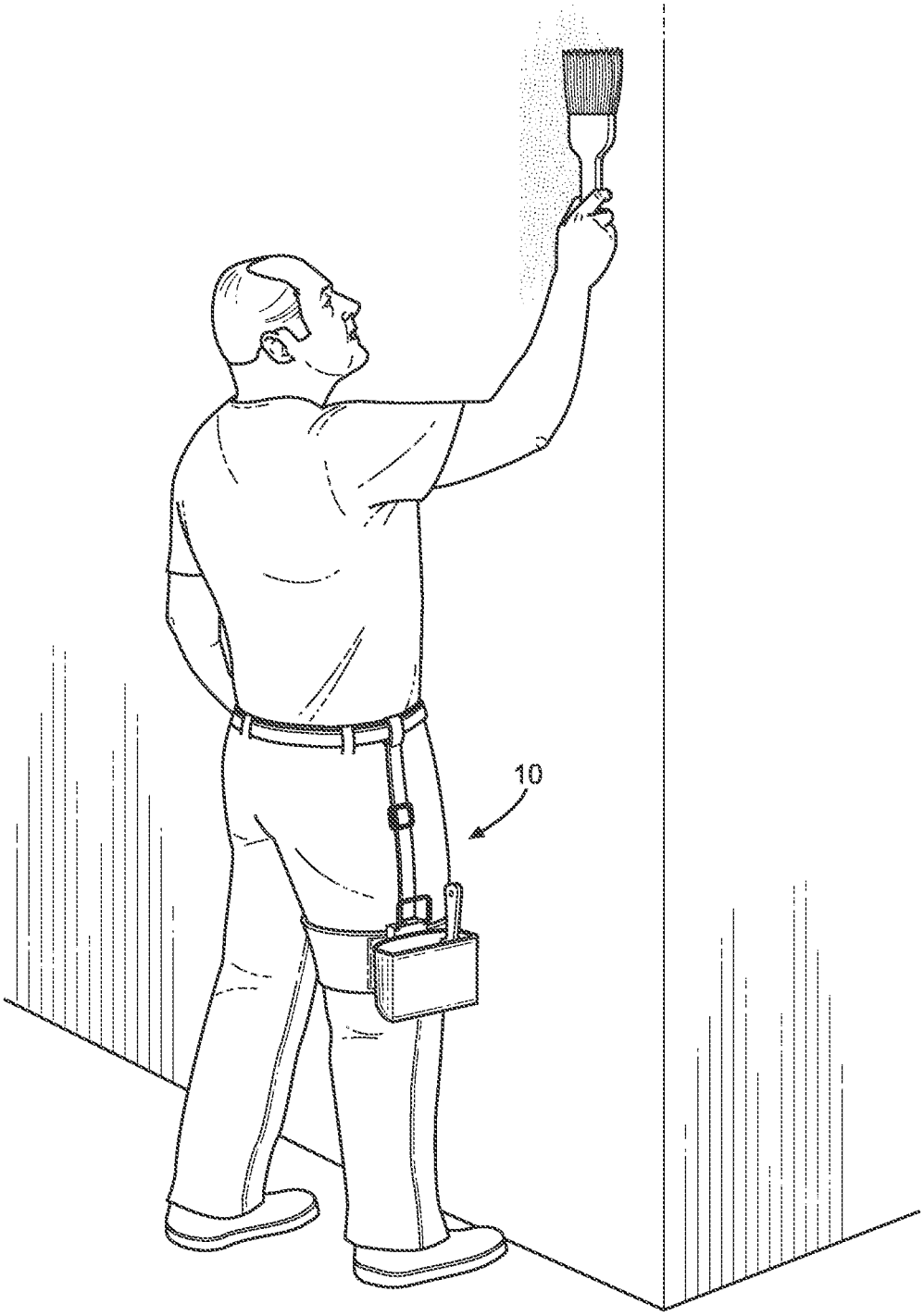
FIG. 4 is a perspective view of one embodiment of the present disclosure, shown in use.

As shown, for example, in FIG. 3, the latching mechanism may comprise a latch housing 27 with a pull handle 28 extending from a top surface thereof, the latch housing 27 designed to envelope a latching system, wherein the latching system comprises a pair of latch springs 48 positioned within notches in the latch housing 27, a latch 38 comprising a bar with an angled notch cut therein, wherein ends of the latch 38 are each attached to one of the pair of latch springs 48, and a pair of crossed latch pivot arms 44, wherein a bottom edge of each latch pivot arm 44 is attached to a respective end of the latch 38. The latch housing 27 may comprise a connection pin orifice 46 extending there through, wherein the connection pin orifice 46 includes a wider insertion portion and a narrower slide portion, the connection pin orifice 46 being sized to accommodate insertion of an end of the connector therein. As shown in the Figures, the connector may comprise a connection pin 26 extending from the strap, wherein when a head on the connection pin 26 is inserted into the connection pin orifice 46, the head removably engages with the angled notch on the latch 38. Because the latch 38 is spring loaded, the connection pin 26 is locked into place while still allowing the latch 36 and, thus, the container body 22 to pivot about the connection pin 26. As shown in the Figures, a top edge of each of the latch pivot arms 44 may be operatively attached to or engaged with a release button 32 that extends externally out of the latch housing 27, wherein, when the release button 32 is pressed, the latch pivot arms 44 push downwards on the latch 38, causing the connection pin 26 to be directed downward to the insertion portion of the connection pin orifice 46, thus allowing removal of the connection pin 26 from the latch housing 27 to disengage the container body 22 from the strap.

The strap may comprise any suitable or desired strap, such as a waist or leg strap. In a particular embodiment, and as shown in FIG. 1, the strap may comprise a leg belt 12 designed to removably encircle a user's leg and secure using a conventional fastener, such as a hook fastener 16 removably engaging with a loop fastener 14. The leg belt 12 may be adjustable in size to accommodate varying sizes of leg. A curved plate 24 may be attached to or embedded within the leg belt 12, wherein the curved plate 24 may mimic the curve of a user's leg. In a particular embodiment, the curved plate 24 may be woven into the leg belt 12, wherein the curved plate 24 may comprise a reinforcement plate to help distribute weight associated with the container body 22. A connection pin 26 may extend outward from the curved plate 24 such that the connection pin 26 extends away from the user. The strap may further comprise a support strap 18 extending substantially perpendicularly from the leg belt 12. For example, the support strap 18 may extend upwards from the portion of the leg belt 12 that comprises the curved plate 24, wherein an end of the support strap 18 distal from the curved plate 26 may comprise a waist belt loop 20 sized to accommodate a user's belt passing there through. Thus, during use, the strap may comprise a support strap 18 removably engaged with a user's belt and a leg belt 12 wrapped around a user's leg.

Figure 2:
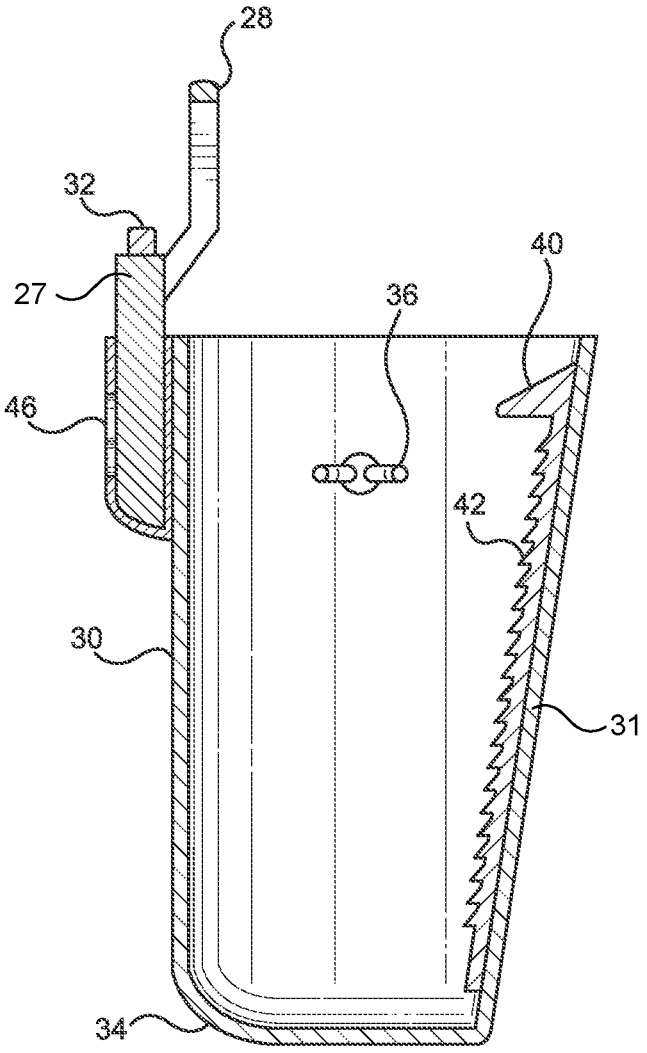
FIG. 2 is a cross-sectional view of one embodiment of the present disclosure.

In embodiments, the paint bucket 10 may comprise additional optional features, such as a brush clip 36 extending from an outer surface thereof, wherein the brush clip 36 may comprise a mandible, such as a plastic mandible, designed to hold the neck of a paint brush. Moreover, the paint bucket 10 may preferably comprise a weighted bottom to help keep the bottom of the container body 22 directed toward the ground surface. Furthermore, as shown in FIG. 2, an interior surface of the container body 22, such as the inner surface of the front wall 31 may comprise a structure for removing excess paint from the paint brush. Specifically, the paint removal structure may comprise a plurality of grates positioned along a height of the inner surface of the front wall 31 and an excess paint lip 40 extending from the inner surface of the front wall 31 toward an interior of the container body 22.

To use the paint bucket 10 of the present disclosure, a user may first attach the leg belt 12 around his or her leg and then pass his or her belt through the waist belt loop 20 on the support strap 18. When positioned correctly, the curved plate 24 will hug the user's leg and the connection pin 26 will extend outward from the user's leg. The container body 22 may then be engaged with the connection pin 26 by inserting the connection pin 26 into the latch housing 27, allowing it to engage with the latch 38. Engagement may be made easier by pressing downward on the pull handle 28. Due to the engagement of the connection pin 26 and the latch 38, the container body 22 may swivel with respect to the leg belt 12 such that the bottom 34 of the container body 22 is always directed toward the floor or ground surface. The user may then place a desired volume of paint or other liquid into the container body 22. During use, the user may dip a paint brush into an interior of the container body 22, removing excess paint or liquid from the brush by running the brush upwards along the grates 42 and excess paint lip 40.

To remove the container body 22 from the leg belt 12, the user may simply push downward on the release button 32, forcing the connection pin 26 to slide downward within the latch housing 27 until it is aligned with the insertion portion of the connection pin orifice 46, at which point, the container body 22 may be simply pulled away from the leg belt 12.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A detachable latching paint bucket sized to accommodate a volume of liquid, the detachable latching paint bucket comprising:

a container body with a bottom and side walls extending upward from the bottom, defining an interior of the container body;

a latching mechanism attached to one of the side walls; and a strap with a connector configured to removably engage with the latching mechanism, such that the container body is designed to swivel with respect to the strap, wherein the strap is configured to removably engage with a user, wherein:

the side walls comprise a curved rear wall and a planar front wall;

the latching mechanism is attached to the curved rear wall; and the bottom is a weighted, curved bottom.

2. The detachable latching paint bucket of claim 1, wherein an inner surface of the planar front wall comprises:

a plurality of grates positioned along a height thereof; and an excess paint lip extending from the inner surface of the front wall toward the interior of the container body.

3. The detachable latching paint bucket of claim 1, wherein the strap comprises:

a leg belt with an adjustable size; and a support strap extending substantially perpendicularly from the leg belt, wherein an end of the support strap distal from the leg belt comprises a waist belt loop designed to removably engage with a waist belt.

4. The detachable latching paint bucket of claim 3, wherein the connector extends outward from the leg belt.

5. A detachable latching paint bucket sized to accommodate a volume of liquid, the detachable latching paint bucket comprising:

a container body with a bottom and side walls extending upward from the bottom, defining an interior of the container body;

a latching mechanism attached to one of the side walls; and a strap with a connector configured to removably engage with the latching mechanism, such that the container body is designed to swivel with respect to the strap, wherein the strap is configured to removably engage with a user, wherein:

the connector comprises a connection pin extending outward from the strap; and the latching mechanism comprises:

a latch housing with a pull handle extending from a top surface thereof;

a latching system housed within the latch housing, the latching system comprising:

a pair of latch springs positioned within notches in the latch housing;

a latch comprising a bar with an angled notch cut therein, wherein a first end of the latch is attached to a first spring of the pair of latch springs and a second end of the latch is attached to a second spring of the pair of latch springs; and a pair of crossed latch pivot arms attached to the latch, wherein a bottom edge of a first arm of the pair of crossed latch pivot arms is attached to the first end of the latch and a bottom edge of a second arm of the pair of crossed latch pivot arms is attached to the second end of the latch; and the latch housing comprises a connection pin orifice extending there through, wherein the connection pin orifice includes a wider insertion portion and a narrower slide portion, the connection pin orifice being sized to accommodate insertion of the connection pin therein.

6. The detachable latching paint bucket of claim 5, further comprising a release button operatively attached to top ends of the first arm and the second arm.

7. A detachable latching paint bucket sized to accommodate a volume of liquid, the detachable latching paint bucket comprising:

a container body with a bottom and side walls extending upward from the bottom, defining an interior of the container body;

a latching mechanism attached to one of the side walls; and a strap with a connector configured to removably engage with the latching mechanism, such that the container body is designed to swivel with respect to the strap, wherein:

the strap is configured to removably engage with a user;

the strap comprises:

a leg belt with an adjustable size; and a support strap extending substantially perpendicularly from the leg belt, wherein an end of the support strap distal from the leg belt comprises a waist belt loop designed to removably engage with a waist belt; and the leg belt includes a reinforcement plate attached thereto, wherein the connector extends outward from the reinforcement plate.

8. The detachable latching paint bucket of claim 7, wherein the reinforcement plate comprises a curved plate.

* * * * *